US006491040B1

(12) United States Patent
Hsueh

(10) Patent No.: US 6,491,040 B1
(45) Date of Patent: Dec. 10, 2002

(54) STRUCTURE OF A HOLDER FOR COMPRESSING A FILTER OF A CIGARETTE

(76) Inventor: Ching Fang Hsueh, PO Box 82-144, Taipei (TW)

( * ) Notice: Subject to any disclaimer, the term of this patent is extended or adjusted under 35 U.S.C. 154(b) by 0 days.

(21) Appl. No.: 09/694,828

(22) Filed: Oct. 24, 2000

(51) Int. Cl.[7] ..... A24F 13/08
(52) U.S. Cl. ..... 131/190; 131/191; 131/199
(58) Field of Search ..... 131/175, 191, 131/178, 187, 189, 190, 199

(56) References Cited

U.S. PATENT DOCUMENTS

| | | | | | |
|---|---|---|---|---|---|
| 237,140 | A | * | 2/1881 | Stone | 131/190 |
| 508,933 | A | * | 11/1893 | Gaylord | 131/190 |
| 999,155 | A | * | 7/1911 | Davis | 131/178 |
| 1,447,664 | A | * | 3/1923 | Hollingsworth | 131/182 |
| 1,490,885 | A | * | 4/1924 | Stein | 131/190 |
| 1,518,663 | A | * | 12/1924 | Martin | 131/182 |
| 1,527,991 | A | * | 3/1925 | Murphy | 131/182 |
| 1,551,973 | A | * | 9/1925 | Brooks | |
| 1,657,919 | A | * | 1/1928 | Dunn | 131/190 |
| 1,767,927 | A | * | 6/1930 | Husted | 131/190 |
| 1,781,553 | A | * | 11/1930 | Mcclees | 131/175 |
| 2,159,018 | A | * | 5/1939 | Dye | 131/178 |
| 2,610,636 | A | * | 9/1952 | Colvin | 131/174 |
| 2,655,157 | A | * | 10/1953 | Weintraub | 131/175 |
| 2,869,883 | A | * | 1/1959 | Dunbar | 131/190 |
| 3,010,458 | A | * | 11/1961 | Lebert | 131/190 |
| 3,303,850 | A | * | 2/1967 | Parrigin | 131/182 |
| 3,921,645 | A | * | 11/1975 | Hagman | 131/182 |
| 4,011,877 | A | * | 3/1977 | Fedorchenko et al. | 131/187 |
| 5,806,532 | A | * | 9/1998 | Kuenzel | 131/248 |

* cited by examiner

*Primary Examiner*—Steven P. Griffin
*Assistant Examiner*—Carlos Lopez
(74) *Attorney, Agent, or Firm*—Leong C. Lei

(57) ABSTRACT

A holder for compressing a filter of a cigarette includes a cylindrical gripping member having an end provided with a plurality of longitudinal pawls, and a tubular mouthpiece formed with an axial passage having an end open to outside and an axial conical recess having a small end in communication with another end of the axial passage, the axial conical recess being formed with a conical surface, whereby when the gripping member is inserted into the mouthpiece, the longitudinal pawls will be forced to move inwardly to compress the filter of a cigarette to one-fifth of its original volume thereby decreasing the amount of nicotine and tars from passing therethrough.

1 Claim, 6 Drawing Sheets

STRUCTURE OF A HOLDER FOR COMPRESSING A FILTER OF A CIGARETTE

CROSS-REFERENCE

This invention is related to U.S. patent application Ser. No. 09/520,222, filed Mar. 7, 2000 now U.S. Pat. No. 6,371,128.

BACKGROUND OF THE INVENTION

1. Field of the Invention

This invention is related to an improvement in a holder for compressing the filter of a cigarette and in particular to one which can compress a filter to one-fifth of its volume thereby decreasing the amount of nicotine and tars from passing therethrough.

2. Description of the Prior Art

As we all know, cigarettes contain chemical substances such as tar and nicotine which are harmful to the health and will be accumulated in the body. It has been reported that tobacco would cause smokers to have lung cancer if they have smoked for a long period of time. Hence, under the pressure of the government and some civil organizations, most cigarette manufacturers have printed warning such as "smoking is a health-risk" on the cigarette pack. However, once one smokes, it is difficult for one to stop smoking simply upon reading the warning on the cigarette pack. Thus, various filtering devices for reducing the amount of tar and nicotine into the body have been developed and sold on the market.

The filtering devices generally fall into two categories, i.e. the first one utilizes chemical substances and the second one a plurality of distorted fins to separate, absorb or discompose tar and nicotine from the cigarette.

However, the chemical substance of the first filtering device ray be inhaled together with the smoke into the smoker's body thereby causing another kind of danger. In addition, such a filtering device is expensive and cannot be accepted by most smokers. The capability of the second filtering device for separating tar and nicotine from smoke will be decreased with time. As a consequence, the second filtering device will become useless and has to be discarded after a certain period of time thereby giving a burden to the smoker.

Therefore, it is an object of the present invention to provide an improvement in the structure of a holder for compressing a cigarette filter which can obviate and mitigate the above-mentioned drawbacks.

SUMMARY OF THE INVENTION

This invention is related to an improvement in the structure of a holder for compressing the filter of a cigarette and in particular to one which can compress a filter to one-fifth of its volume thereby decreasing the amount of nicotine and tars from passing therethrough.

It is the primary object of the present invention to provide a holder which can compress the filter of a cigarette to one-fifth of its original volume thereby decreasing the amount of nicotine and tars from passing therethrough.

It is another object of the present invention to provide a holder for compressing the filter of a cigarette which is simple in construction and low in cost.

According to a preferred embodiment of the present invention, a holder for compressing a filter of a cigarette includes a cylindrical gripping member having an end provided with a plurality of longitudinal pawls, and a tubular mouthpiece formed with an axial passage having an end open to outside and an axial conical recess having a small end in communication with another end of the axial passage, the axial conical recess being formed with a conical surface, whereby when the gripping member is inserted into the mouthpiece, the longitudinal pawls will be forced to move inwardly to compress the filter of a cigarette to one-fifth of its original volume thereby decreasing the amount of nicotine and tars from passing therethrough.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
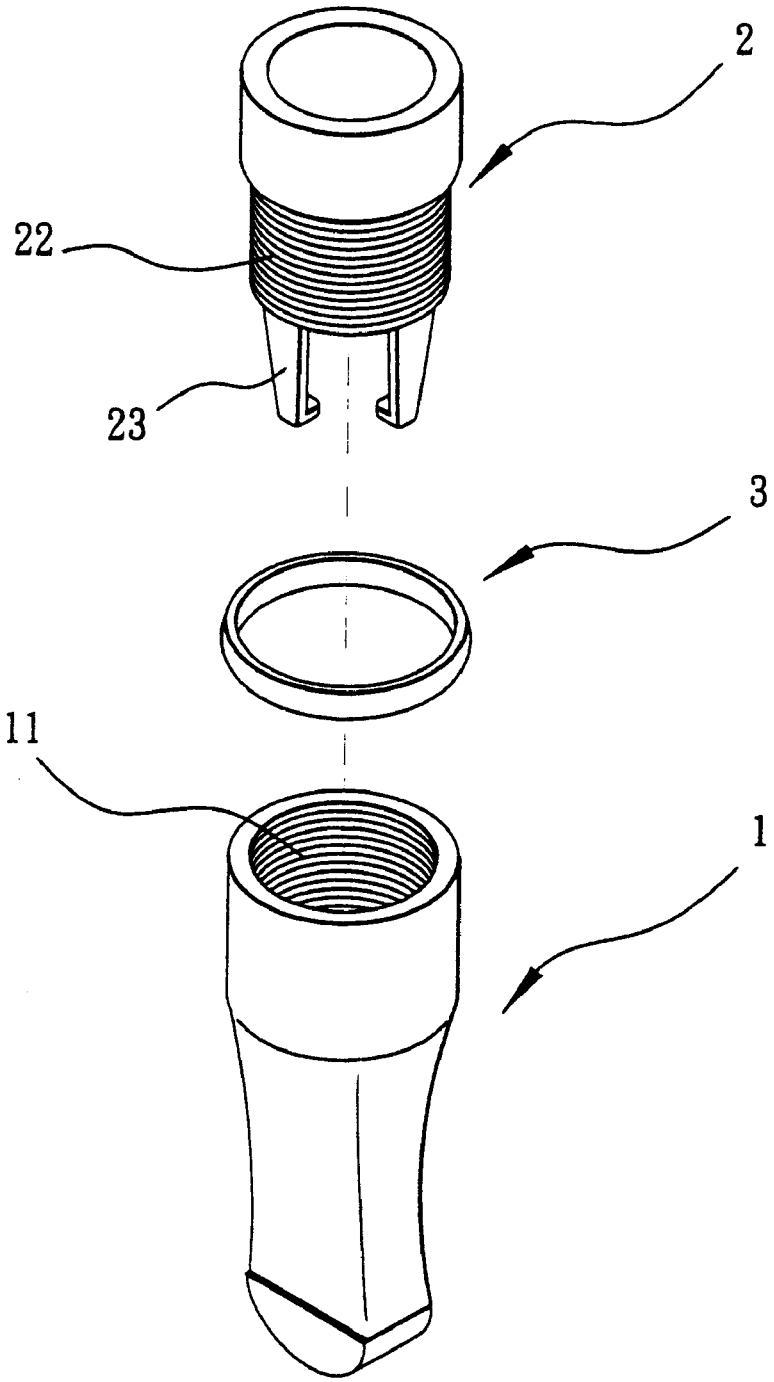
FIG. 1 is an exploded perspective view of a first preferred embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
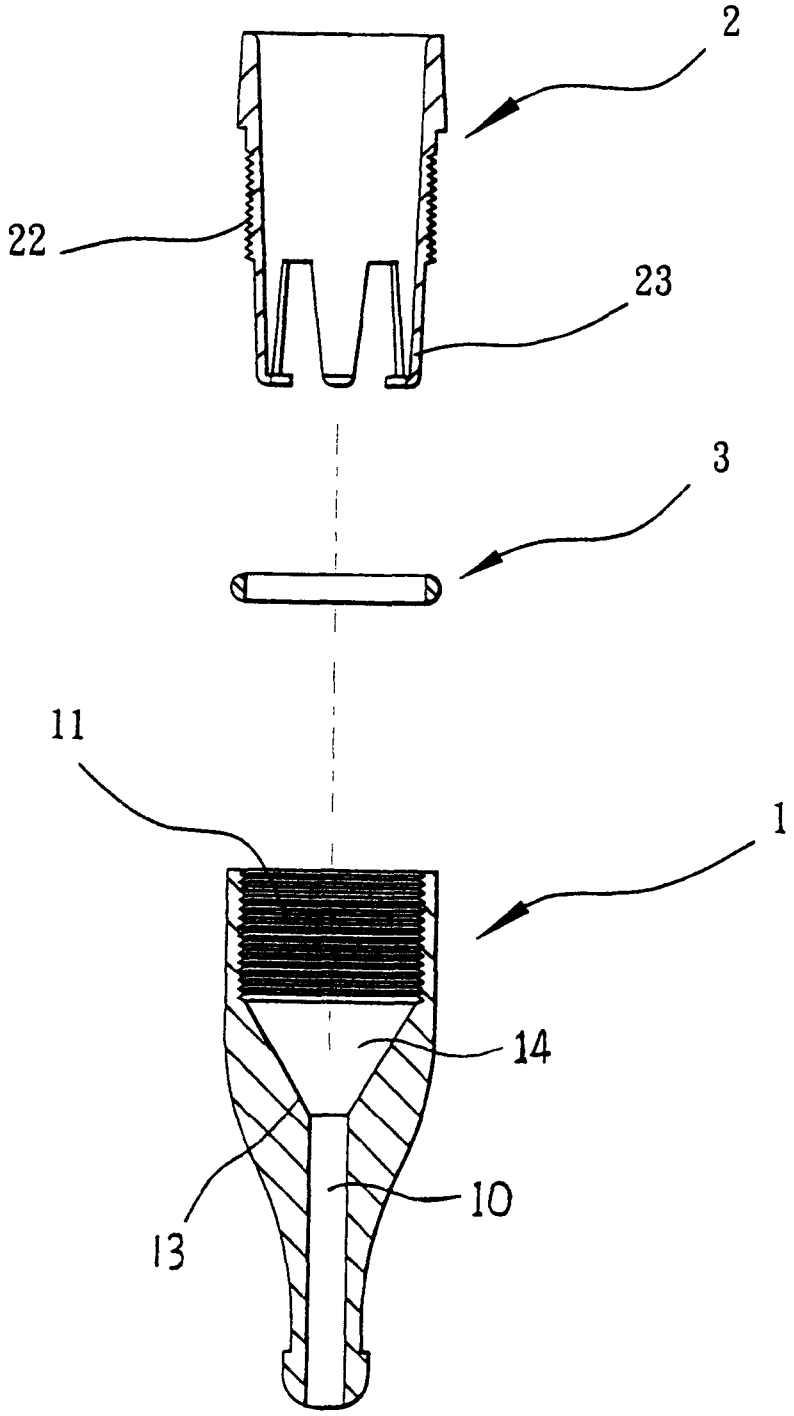
FIG. 2 is an exploded sectional view of the present invention.

With reference to the drawings and in particular to FIGS. 1 and 2 thereof, the holder according to the present invention generally comprises a mouthpiece 1 and a gripping member 2. The mouthpiece 1 is a tubular member formed with an axial passage 10 having an end open to the outside, an axial conical recess 14 having a small end in communication with the other end of the axial passage 10, and an internally threaded cylindrical hole 11 having an end open to the outside and the other end in communication with the large end of the axial conical recess 14. The axial conical recess 14 is formed with a conical surface 13. The gripping member 2 is a cylindrical member having a plurality of longitudinal pawls 23 at one end and a plurality of external threads 22 at the intermediate portion thereof.

Figure 3:
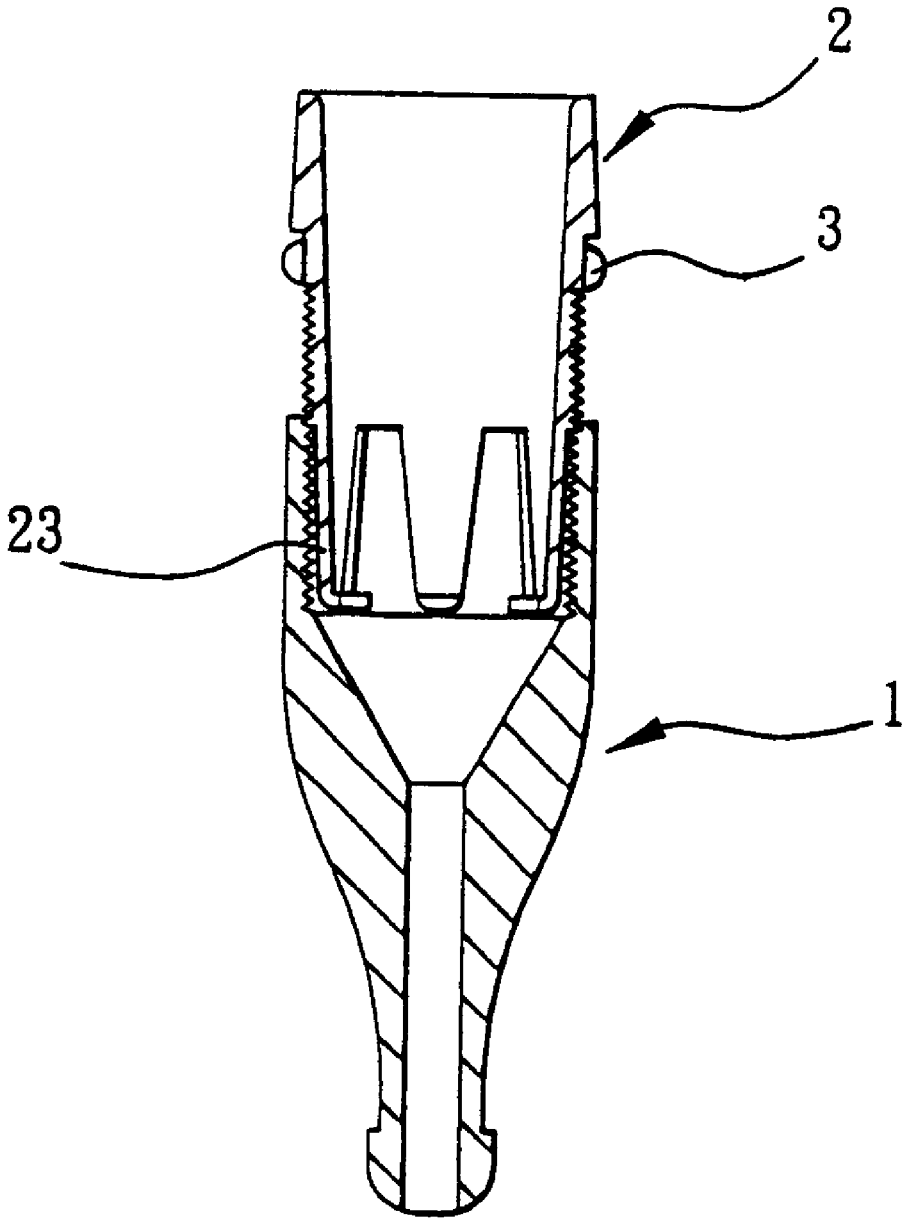
FIG. 3 is a sectional view of the present invention.
Figure 4:
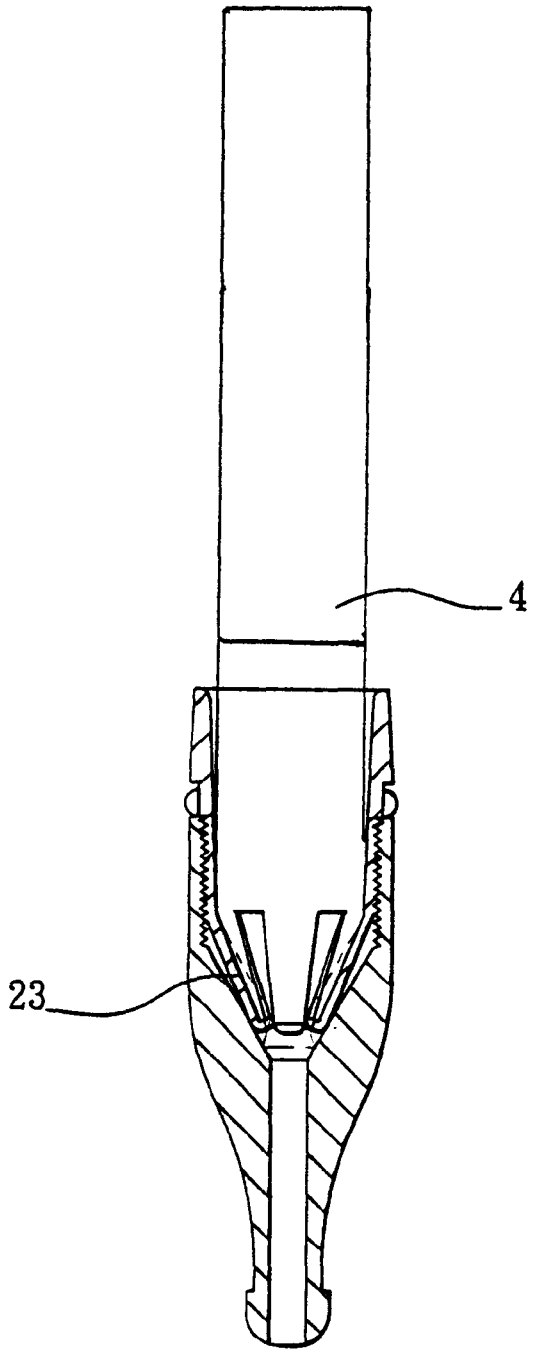
FIG. 4 is a sectional view illustrating how the holder is engaged with a cigarette.
Figure 7:
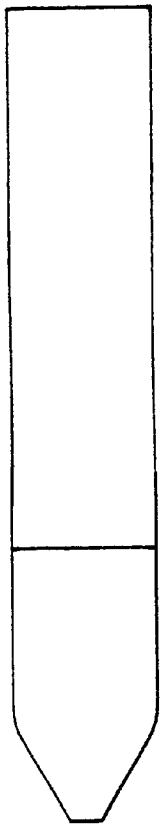
FIG. 7 illustrates the shape of a cigarette having been compressed by the first preferred embodiment of the present invention.

In assembly, the gripping member 2 is inserted into the mouthpiece 1, with the external threads 22 of the former engaged with the internally threaded cylindrical hole 11 of the latter, so that the gripping member 2 can be turned into the mouthpiece 1 (see FIG. 3) and the filter of a cigarette 4 can be inserted into the gripping member 2. As the gripping member 2 is further turned into the mouthpiece 1, the pawls 23 of the gripping member 2 will be first in contact with the conical surface 13 of the mouthpiece 1 and then forced to move inwardly to compress the filter of the cigarette 4 (see FIG. 4). As a consequence, the filter of the cigarette 4 is compressed to one-fifth of its original volume thereby decreasing the amount of nicotine and tars from passing therethrough (see FIG. 7). However, the compression of the filter of the cigarette 4 can be adjusted to change the concentration of the cigarette as desired simply by turning the gripping member 2 with respect to the mouthpiece 1. In addition, a decoration ring 3 with desired color may be mounted between the gripping member 2 and the mouthpiece 1 to beautify the outlook of the holder.

Figures 5A, 5B:
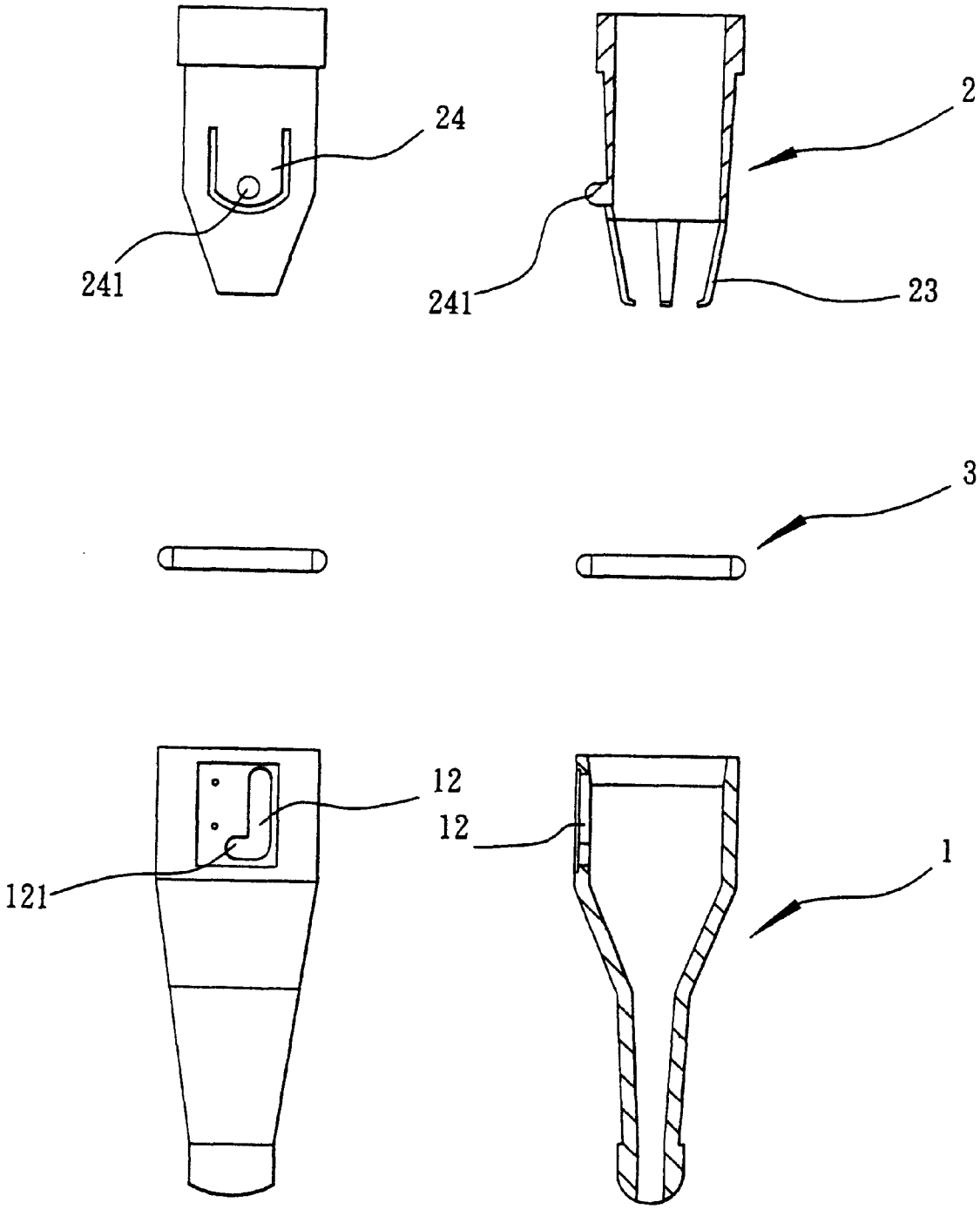
FIG. 5A is an exploded perspective view of a second preferred embodiment of the present invention.
FIG. 5B is an exploded sectional view of the second preferred embodiment of the present invention.
Figure 6:
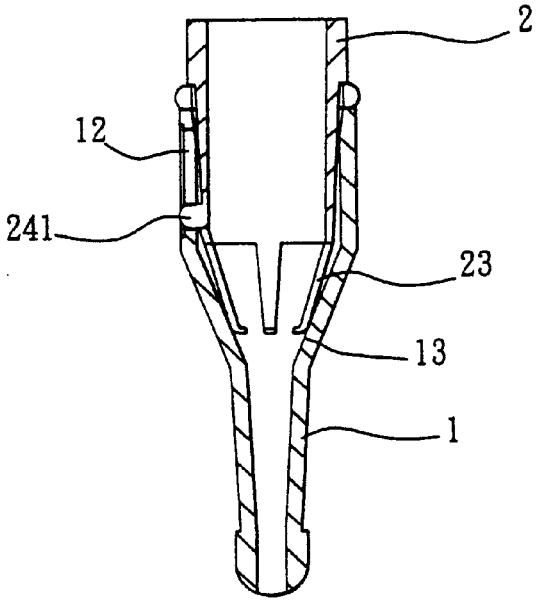
FIG. 6 is a sectional view of the second preferred embodiment of the present invention.
Figure 8:
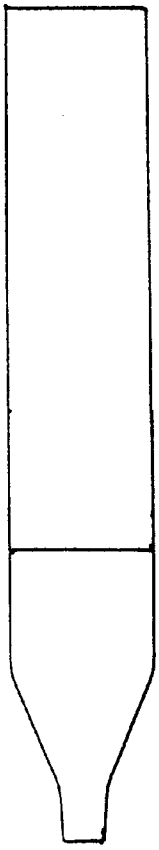
FIG. 8 illustrates the shape of a cigarette having been compressed by the second preferred embodiment of the present invention.

FIGS. 5A, 5B and 6 illustrate a second preferred embodiment of the present invention. As shown, the second preferred embodiment of the present invention is substantially the same as the first preferred embodiment, except that the gripping member 2 and the mouth piece 1 of the former are formed with a resilient tongue 24 and an L-shaped slot 12 respectively. As shown in FIGS. 5A, 5B and 6, the gripping member 2 has a U-shaped groove 12 on its outer cylindrical surface thereby forming resilient tongue 24 on which there is a protuberance 241. The outer portion of the gripping member 2 is also provided with a plurality of longitudinal pawls 23. The mouthpiece 1 has an L-shaped slot 12 on its upper portion configured to receive the protuberance 241 of the tongue 24. In assembly, the gripping member 2 is inserted into the recess 14 of the mouthpiece 1. The filter of a cigarette is inserted into the gripping member 2 before the pawls 23 get in touch with the conical surface 13 of the mouthpiece 1. The length of the filter of the cigarette fitted into the mouthpiece 1 can be adjusted as desired. Then, the gripping member 2 is further turned into the mouthpiece 1 to compress the filter of the cigarette (see FIG. 8) thereby decreasing the amount of nicotine and tars from passing therethrough. Finally, the protuberance 241 of the tongue 24 is engaged with the end 121 of the L-shaped slot 12 to keep the gripping member 2 engaging with the mouthpiece 1 (see FIG. 6). As the first preferred embodiment, a decoration ring 3 is mounted between the gripping member 2 and the mouthpiece 1 for beautifying the outlook of the holder.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A holder for compressing a filter of a cigarette comprising:

a cylindrical gripping member having an end provided with a plurality of longitudinal pawls; and a tubular mouthpiece formed with an axial passage having an end open to outside and an axial conical recess having a small end in communication with another end of said axial passage, said axial conical recess being formed with a conical surface;

wherein said mouthpiece has an L-shaped slot and said gripping member has an outer cylindrical surface provided with a protuberance which will engage with an end of said L-shaped slot when said gripping member is completely turned into said mouthpiece, said protuberance is provided on a resilient tongue of said gripping member;

whereby when said gripping member is inserted into said mouthpiece, said longitudinal pawls will be forced to move inwardly into said mouthpiece to compress a filter of a cigarette inserted into said gripping member.

* * * * *